US005931454A

United States Patent [19]

Kondo et al.

[11] Patent Number: 5,931,454

[45] Date of Patent: Aug. 3, 1999

[54] RECYCLE DOCUMENT FEEDER

[75] Inventors: Kazuhisa Kondo; Toru Tanjo; Hiroshi Kobayashi; Hiroyuki Harada; Masahiro Sako; Jun Kusakabe, all of Osaka, Japan

[73] Assignee: Mita Industrial Co., Ltd., Osaka, Japan

[21] Appl. No.: 08/998,816

[22] Filed: Dec. 29, 1997

[30] Foreign Application Priority Data

Jan. 17, 1997 [JP] Japan ..... 9-007066

[51] Int. Cl.[6] ..... B65H 5/22

[52] U.S. Cl. ..... 271/3.04; 271/3.05; 271/3.13; 271/3.15; 271/3.16; 271/3.19; 271/273; 271/303; 399/370; 399/372; 399/376; 399/373

[58] Field of Search ..... 399/370, 372, 399/373, 376, 377; 271/3.02, 3.04, 3.05, 3.13, 3.15, 3.16, 3.19, 171, 273, 274, 264, 301, 303

[56] References Cited

U.S. PATENT DOCUMENTS

| | | | |
|---|---|---|---|
| 4,935,780 | 6/1990 | Yamada et al. | 271/122 |
| 5,797,597 | 8/1998 | Kakuta et al. | 271/96 |
| 5,822,673 | 10/1998 | Tanjo | 399/373 |

FOREIGN PATENT DOCUMENTS

| | | | |
|---|---|---|---|
| 0229765 | 10/1986 | Japan | 271/273 |
| 1-187168 | 7/1989 | Japan . | |
| 0271363 | 10/1989 | Japan | 271/301 |
| 0066052 | 3/1990 | Japan | 271/303 |

*Primary Examiner*—H. Grant Skaggs
*Attorney, Agent, or Firm*—Smith, Gambrell & Russell, LLP; Beveridge, DeGrandi, Weilacher & Young Intellectual Property Group

[57] ABSTRACT

A recycle document feeder according to the present invention includes a cover (251) covering a document discharge portion (30). The cover (251) is openably supported by a pivot shaft (256) between a pair of frames (255). A feedback path (32) for guiding a document original onto a document placing plate is defined by a pair of guide members (257, 258) provided in an opposed relation. The upper guide member (258) is attached to the interior face of the cover (251). A switch claw (253) for switching the document traveling direction is attached to the pivot shaft (256) which supports the cover (251). Thus, there is no need for additionally providing a shaft for supporting the switch claw (253), thereby simplifying the construction of the document discharge portion (30).

10 Claims, 7 Drawing Sheets

DOCUMENT RECYCLE
COMPLETION OF COPYING OPERATION
17
102
103
30
D
D1
Dn
18
19.20
11.12
13
14
1

RECYCLE DOCUMENT FEEDER

This invention is based on application No. 9-7066 filed in Japan, the contents of which is incorporated hereinto by reference.

BACKGROUND OF THE INVENTION

1. Field of the Invention

The present invention relates to a recycle document feeder which is mounted on an image forming apparatus such as a copying machine, a facsimile machine, an image reader or the like, and adapted to feed a document original to be read by the image forming apparatus from a document placing plate to a reading position and then back onto the document placing plate after image reading of the document original.

2. Description of Related Art

A document feeder has been proposed which is to be mounted on a copying machine, for example, and designed such that a document original set on a document placing plate is automatically fed onto a contact glass of the copying machine and, after the document original is subjected to an image reading operation by the copying machine, a switch claw is switched either to feed the document original back onto the document feeding plate or to discharge the document original out of the feeder through a discharge port (see Japanese Unexamined Patent Publication No. 1-187168 (1989).

Some prior-art document feeders have a document discharge portion covered with a discharge portion cover which can be opened, when a document transportation failure (e.g., document jam) occurs in a discharge path within the document discharge portion, so as to remove the jammed document from the discharge path.

Where a document feeder having a switch claw as disclosed in the aforesaid publication is provided with a discharge portion cover which openably covers a document discharge portion, however, the document discharge portion tends to have a complicated construction with an increased size.

SUMMARY OF THE INVENTION

In order to solve the aforesaid problem, it is an object of the present invention to provide a recycle document feeder which includes a document discharge portion of a simplified construction and a switch claw for switching a document discharging direction and yet ensures that, when a document transportation failure occurs, a document original involved in the transportation failure can be removed from the document discharge portion.

In accordance with the present invention, there is provided a recycle document feeder which comprises: a document placing plate for holding thereon document originals to be fed; feed means for feeding the document originals previously set on the document placing plate one by one into a transportation path; transportation means for transporting a document original through the transportation path; a feed-back path for feeding the document original once fed into the transportation path back onto the document placing plate; a discharge port branched from the feed-back path for discharging therethrough the document original out of the feeder; a cover pivotal about a pivot shaft and covering at least the feed-back path; and a switch claw pivotal about a pivot shaft provided in a coaxial relation with respect to the pivot shaft of the cover for switching a path through which the document original is guided either to the feed-back path or to the discharge port, depending on its pivoted position.

The switch claw for switching the path through which the document original transported through the transportation path is guided either to the feed-back path or to the discharge port for discharging the document original out of the feeder is pivotal about the pivot shaft provided in a coaxial relation with respect to the pivot shaft of the cover. Therefore, a space can drastically be saved in comparison with a case where these pivot shafts are disposed along different axes. Particularly, where the switch claw and the cover share a single pivot shaft, there is no need for additionally providing a shaft for supporting the switch claw, thereby simplifying the construction of the feeder.

DESCRIPTION OF THE PREFERRED EMBODIMENT

A recycle document feeder for a copying machine will hereinafter be described in detail as one embodiment of the present invention. It should be understood that the present invention is not limited to the recycle document feeder for the copying machine, but is applicable to a recycle document feeder for a facsimile machine and a recycle document feeder for an image reader to be connected to a computer and the like.

Figure 1:
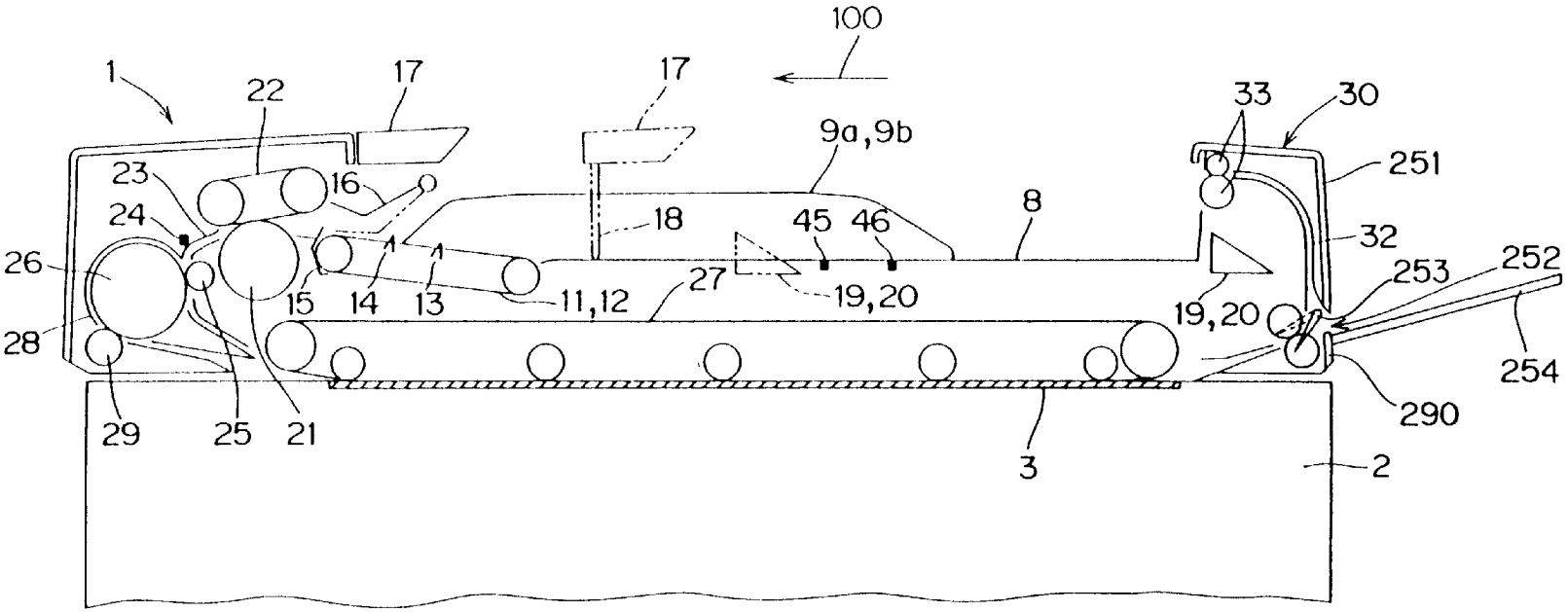
FIG. 1 is a schematic diagram illustrating the internal construction of a recycle document feeder according to one embodiment of the present invention as viewed from its front side.
Figure 2:
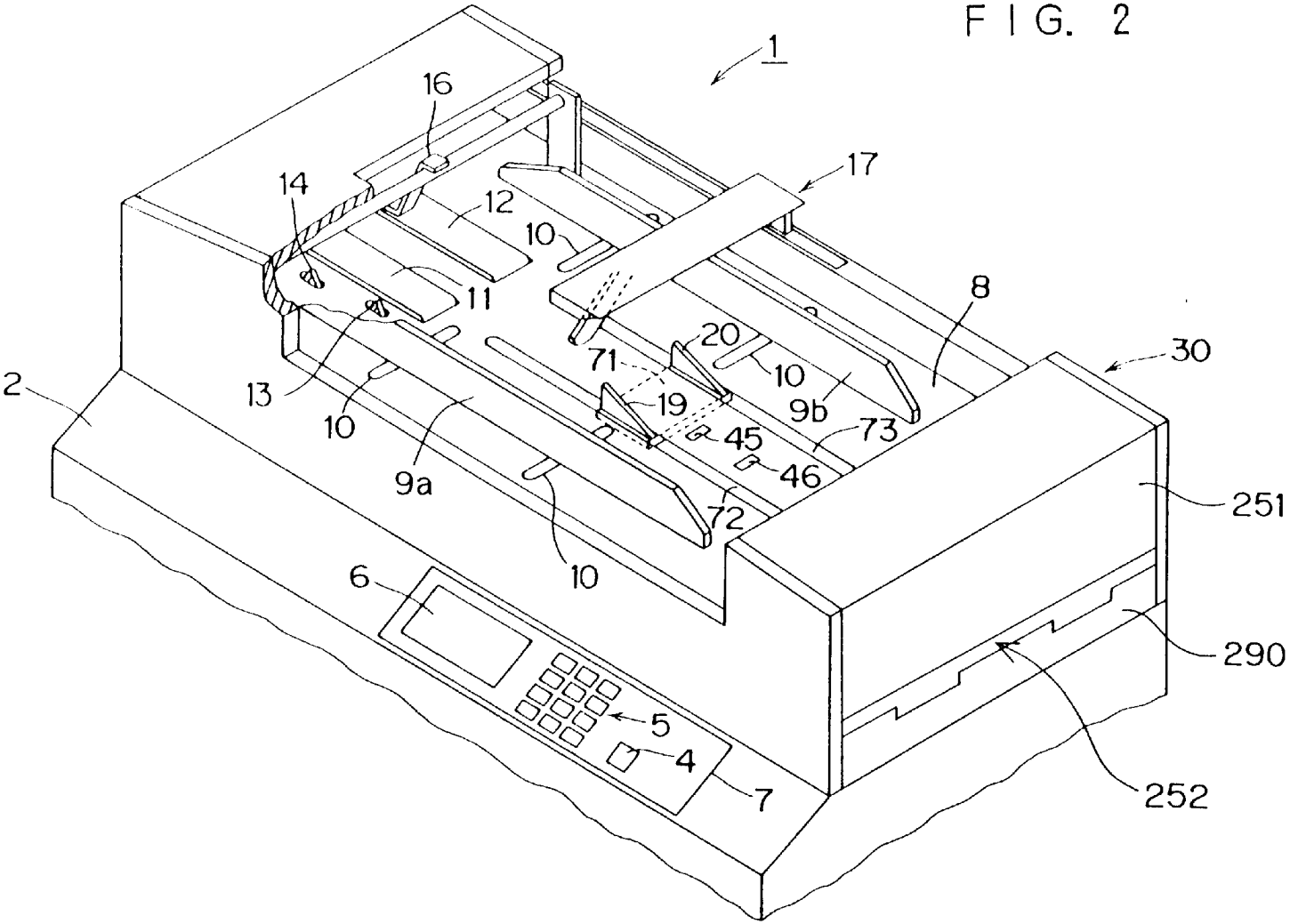
FIG. 2 is a partially cut away perspective view of the recycle document feeder shown in FIG. 1.

FIG. 1 is a sectional view schematically illustrating the inside construction of the recycle document feeder according to the embodiment of the present invention as viewed from its front side. FIG. 2 is a partially cutaway perspective view of the recycle document feeder shown in FIG. 1.

Referring generally to FIG. 1 and occasionally to FIG. 2, the recycle document feeder 1 is rested on the upper face of a copying machine body 2, and adapted to automatically feed a document original onto a contact glass 3 provided on the upper face of the copying machine body 2 and then back to the original position after image reading thereof. The document original thus fed back to the original position is allowed to be fed again onto the contact glass 3. The recycle document feeder 1 also serves as a cover of the contact glass 3, which is adapted to be opened upward pivotally about the rear edge of the recycle document feeder 1 to expose the contact glass 3 on which a document original can manually be placed.

Provided on a front top face of the copying machine body 2 is an operation panel 7 having operation keys such as a print key 4 and ten-keys 5 and a display portion 6 arranged thereon. The copying machine body 2 and the recycle document feeder 1 are operated through the operation panel 7.

A document placing plate 8 for holding thereon a stack of document originals to be fed onto the contact glass 3 is provided in the center of the upper face of the recycle document feeder 1. The document placing plate 8 is capable of accepting document originals having a A5 (JIS Column A No. 5) size to an A3 (JIS Column A No. 3) size, for example. On the document placing plate 8 is provided a pair of document width regulating guides 9*a* and 9*b* for positioning the stack of document originals placed on the document placing plate 8 relative to a direction perpendicular to a document feeding direction (relative to the width of the document stack) and guiding the document originals fed back on the document placing plate 8. The document width regulating guides 9*a* and 9*b* are adapted to be moved toward and away from each other along a rail 10 in an interlocked relation, and is manually operated so as to conform to the width of the document stack placed on the document placing plate 8.

Two feed belts 11 and 12 for guiding the stack of document originals placed on the document placing plate 8 to a predetermined setting position and starting the feeding of the document originals are provided adjacent to the document placing plate 8. More specifically, the two feed belts 11 and 12 are disposed in a parallel relation perpendicular to the document transportation direction.

A preset switch 13 for sensing that the document originals are placed on the document placing plate 8 is provided on an upstream side of the feed belt 11. When a user places a stack of document originals on the document placing plate 8, the preset switch 13 is turned on to start driving the feed belts 11 and 12. The stack of document originals placed on the document placing plate 8 is transported in the direction of an arrow 100 (leftward as seen in FIG. 1) by the driving of the feed belts 11 and 12.

A set switch 14 is provided downstream of the preset switch 13 relative to the document transportation direction. The driving of the feed belts 11 and 12 are stopped after a lapse of a predetermined time period from a time point at which the set switch 14 is turned on by the transported document stack. Thus, the stack of document originals is set in the predetermined setting position.

A leading edge stopping member 15 for stopping the leading edges of the document originals set in place is provided downstream of the feed belts 11 and 12 to prevent the document originals from being inserted downstream of the setting position in the document transportation direction. Further, the leading edge stopping member 15 prevents a user unfamiliar with the handling of the document feeder from inadvertently inserting document originals downstream of the setting position in the document transportation direction.

When the print key 4 on the copying machine body 2 is pressed with the document originals thus set in place, a partitioning unit 17 previously located in its home position (as indicated by a solid line in FIG. 1) above the feed belts 11 and 12 is moved in a direction opposite to the document transportation direction by a certain distance corresponding to the size of the document originals so as to be located in a position as indicated by a two-dot-and-dash line in FIG. 1. The partitioning unit 17 includes a partitioning bar 18, which can be shifted between an inactive state where it is retracted within the partitioning unit 17 and an active state where it stops the leading edges of document originals fed back onto the document placing plate 8. When the document originals are subjected to a document feeding operation, the partitioning bar 18 is lowered to assume the active state, whereby the leading edges of document originals fed back onto the document placing plate 8 through a document discharge portion 30 (which will be described later) are aligned and the document originals subjected to the document feeding operation are divided from the document originals yet to be subjected to the document feeding operation.

Further, two action plates 19 and 20 previously located in their home positions (as indicated by a solid line in FIG. 1) within the document discharge portion 30 are moved in the document transportation direction by a distance, which depends on the size of the document originals set in place, so as to be located in a position as indicated by a two-dot-and-dash line in FIG. 1. The action plates 19 and 20 are coupled by a coupling plate 71 below the document placing plate 8 (see FIG. 2), and adapted to be moved in unison along guide rails 72 and 73 extending in a direction perpendicular to the document transportation direction in a spaced relation on the document placing plate 8.

The action plates 19 and 20 are each comprised of a generally right-angled triangular planar plate having an edge inclined upward toward the document transportation direction as viewed in a direction perpendicular to the direction of their movement. Therefore, a first document original is guided by the inclined edges of the action plates 19 and 20 and to be fed back onto the document placing plate 8 so that the leading edge of the document original is prevented from bumping against the trailing edges of the document originals set in the setting position and rested thereon. When the first document original is fed back onto the document placing plate 8, the action plates 19 and 20 are retracted to their home positions.

A mechanism for sensing the size of the document originals and a driving mechanism for driving the partitioning unit 17 and the action plates 19 and 20 will be detailed later.

A pressing member 16 provided above the feed belt 12 is shifted from an upper position as indicated by a solid line to a lower position as indicated by a two-dot-and-dash line in FIG. 1 thereby to press the leading edge of the document stack set in the setting position against the feeding belt 12. The leading edge stopping member 15 is lowered, and the driving of the feed belts 11 and 12 is then started to make the document feeding operation.

A separator roller 21 is disposed downstream of the leading edge stopping member 15 relative to the document transportation direction, and a separator belt 22 is opposed to the separator roller 21. The lowermost one of the document originals (might be of multiple) fed by the feed belts 11 and 12 is separated from the other document originals and fed into a document transportation path 23.

The document original fed into the document transportation path 23 reaches a resist switch 24 provided in the document transportation path 23 thereby to turn on the resist switch 24. After a lapse of a predetermined time period from the turn-on of the resist switch 24, the driving of the feed belts 11 and 12, the separator roller 21 and the separator belt 22 is stopped. At this time, the leading edge of the document original fully abuts against a nipping position between a resist roller 25 and a resist/reverse roller 26, whereby the leading edge portion of the document original has a certain degree of slack. This prevents the document original from being transported at an angle with respect to the document transportation path 23 (so-called slant document feeding).

Thereafter, the transportation of the document original is resumed by starting the rotative driving of the resist roller 25 and the resist/reverse roller 26 in association with the operation of the copying machine body 2.

The document original transported by the resist roller 25 and the resist/reverse roller 26 is placed in a predetermined position on the contact glass 3 of the copying machine body 2 by a transportation belt 27. Where only an image on one side of the document original is to be read, a document image reading operation is performed by the copying machine in this state. Conversely, where images on both sides of the document original are to be read, the document original is reversed before the image reading operation.

More specifically, the document original placed on the contact glass 3 is taken back into a reversing path 28 by the transportation belt 27. The document original thus taken back is transported through the reversing path 28 by the transportation belt 27, the resist/reverse roller 26, a reverse roller 29 and the resist roller 25, and placed on the contact glass 3 again by the transportation belt 27. At this time, the back side of the document original is faced with the contact glass 3. Then, the document original is subjected to the image reading operation by the copying machine so that the image on the back side of the document original is first read. Thereafter, the document original is reversed again, and the image on the front side of the document original is read.

The document original subjected to the image reading operation is transported into the document discharge portion 30 by the transportation belt 27. The upper face and right side face of the document discharge portion 30 as seen in FIG. 1 is covered with a cover 251 rotatably supported by a feeder body. The document discharge portion has a feed-back path 32 provided therein for guiding the document original transported therein onto the document placing plate. A feed roller pair 31 and a feed-back roller pair 33 are provided on the upstream side and downstream side, respectively, of the feed-back path 32 with respect to the document transportation direction. A lower cover 290 is attached to the document discharge portion below the cover 251. A discharge port 252 is defined between the cover 251 and the lower cover 290 for discharging therethrough the document original transported into the document discharge portion 30 out of the feeder.

A switch claw 253 for switching the traveling direction of the document original transported into the document discharge portion 30 is provided adjacent to the downstream side of the feed roller pair 31 in the document discharge portion 30. The switch claw 253 can be shifted between a recycle position (as indicated by a solid line in FIG. 1) which permits the document original transported into the document discharge portion 30 to be guided to the feed-back path 32 and a discharge position (as indicated by a two-dot-and-dash line in FIG. 1) which permits the document original to be discharged from the discharge port 252.

Where the switch claw 253 is in the recycle position, the document original transported into the document discharge portion 30 by the transportation belt 27 is further transported through the feed-back path 32 by the feed roller pair 31 and then fed back onto the document placing plate 8 by the feed-back roller pair 33. Conversely, where the switch claw 253 is in the discharge position, the document original transported by the feed roller pair 31 is guided to the discharge port 252 and discharged into a discharge tray 254 (see FIG. 1) provided in association with the discharge port 252.

Figure 3:
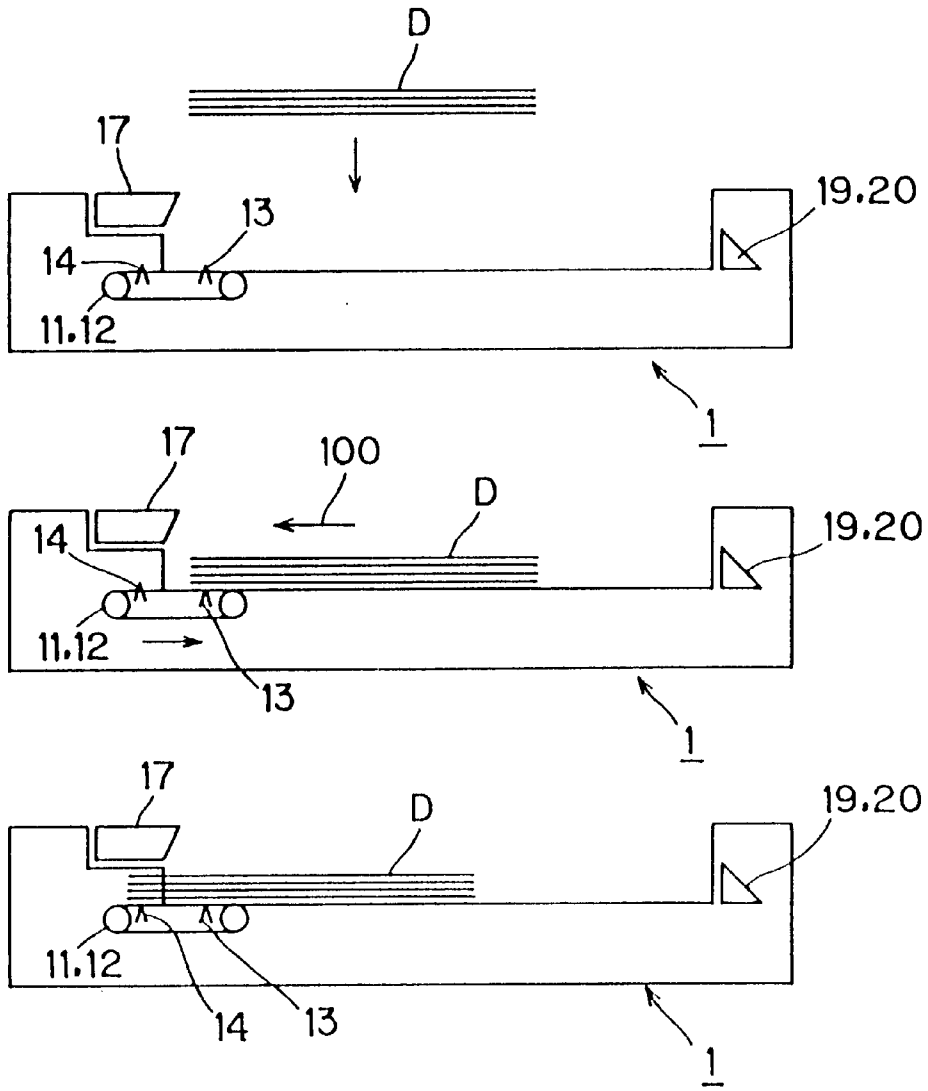
FIGS. 3(*a*) to 3(*c*) are schematic diagrams illustrating an operation of the recycle document feeder, particularly, to be performed when document originals are set in place.

FIGS. 3(*a*) to 3(*c*) and 4(*a*) to 4(*g*) are schematic diagrams illustrating operations of the recycle document feeder 1. FIGS. 3(*a*) to 3(*c*) illustrate an operation to be performed when the document originals are set, while FIGS. 4(*a*) to 4(*g*) illustrate an operation to be performed when the document originals are transported.

The document setting operation will be described with reference to FIGS. 3(*a*) to 3(*c*).

When no document original is placed on the document placing plate 8, the preset switch 13 and the set switch 14 are off and the feed belts 11 and 12 are not driven as shown in FIG. 3(*a*).

When a user places a stack of document originals D on the document placing plate 8 after adjusting the document width regulating guides 9*a* and 9*b* in conformity with the size of the document originals, the preset switch 13 is pressed by the weight of the document originals D thereby to be turned on. Thus, the feed belts 11 and 12 start rotating counter-clockwise as seen in FIG. 3(*b*), thereby transporting the stack of document originals D on the document placing plate 8 in the direction of the arrow 100 (see FIG. 3(*b*)).

When the stack of document originals D is transported in the direction of the arrow 100 so that the leading edge of the document stack reaches the set switch 14, the set switch 14 is pressed by the document originals D. After a lapse of the predetermined time period from the turn-on of the set switch 14, the feeding of the feed belts 11 and 12 is stopped, whereby the stack of document originals D is set in the predetermined setting position in a state as shown in FIG. 3(*c*). The size of the document originals thus set is determined on the basis of outputs of the document width sensor 42 and the two document length sensors 45 and 46 in this state.

Figures 4A, 4B, 4C, 4D, 4E, 4F, 4G:
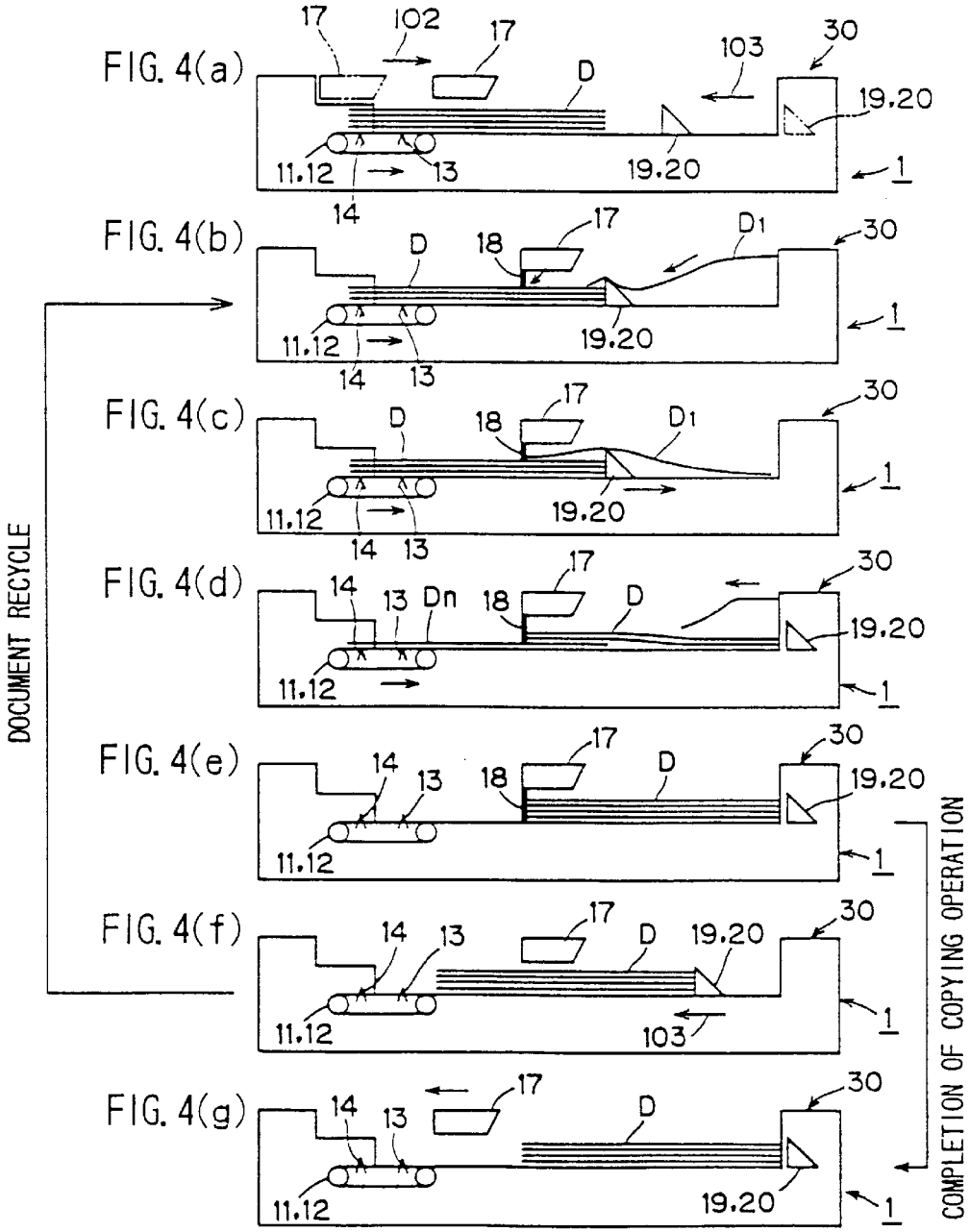
FIGS. 4(*a*) to 4(*g*) are schematic diagrams illustrating an operation of the recycle document feeder, particularly, to be performed when the document originals are transported.

Referring to FIGS. 4(*a*) to 4(*g*), an explanation will next be given to the document transporting operation, mainly to the operations of the partitioning unit 17 and the action plates 19 and 20.

When the print key 4 on the copying machine body 2 (see FIG. 2) is pressed after the document originals are set as shown in FIG. 3(*c*), the partitioning unit 17 is moved in the direction of an arrow 102 (in the direction opposite to the document transportation direction) from its home position indicated by a two-dot-and-dash line as shown in FIG. 4(*a*). The action plates 19 and 20 are moved in the direction of an arrow 103 (in the document transportation direction) from their home positions indicated by a two-dot-and-dash line. The amounts of the movement of the partitioning unit 17 and the action plates 19 and 20 are determined by the size of the document originals D set in place. More specifically, the partitioning unit 17 is moved to such a position that a distance between the partitioning bar 18 and the downstream edge of the document discharge portion 30 is equal to the document length (the length of the document originals D as measured in the document transportation direction) when the partition bar 18 of the partitioning unit 17 is lowered. The action plates 19 and 20 are moved to such a position that the downstream edges of the action plates 19 and 20 are brought in contact with the trailing edge of the stack of document originals D set in the setting position.

Simultaneously with the movement of the partitioning unit 17 and the action plates 19 and 20, the driving of the feed belts 11 and 12, the separator roller 21 and the separator belt 22 is started to feed the lowermost document $D_1$ out of the document placing plate 8. Upon completion of the movement of the partitioning unit 17 and the action plates 19 and 20, the partitioning bar 18 of the partitioning unit 17 is lowered so that a tip of the partitioning bar 18 abuts against the top surface of the stack of document originals D set in the setting position.

Referring to FIG. 4(*b*), the first document original (the lowermost document original at the document setting) $D_1$ fed back onto the document placing plate 8 after being subjected to the image reading operation for copying thereof is guided by the action plates 19 and 20 which have been moved forward, and the leading edge thereof is rested on the stack of document originals set in the setting position. Therefore, the document original $D_1$ fed back onto the document placing plate 8 is prevented from bumping against the stack of document original D set in the setting position, so that the document originals $D_1$ is not folded nor inserted between the document originals D. Since the leading edge of the document original $D_1$ thus fed back is stopped by the partitioning bar 18, the document original $D_1$ is not pushed downstream in the document transportation direction by an impetus added thereto when it is discharged from the document discharge portion. Thus, the document original $D_1$ thus fed back is divided from the document originals yet to be fed, thereby preventing needless document re-feeding.

When the first document original $D_1$ is fed back onto the document placing plate 8 as shown in FIG. 4(*c*), the action plates 19 and 20 are retracted to their home positions. Even with the action plates 19 and 20 retracted to their home positions, the second and subsequent document originals are properly guided on the first document original $D_1$ and, therefore, are not inserted between the document originals D set in the setting position. Since the partitioning bar 18 is kept lowered, the leading edges of the document originals fed back onto the document placing plate 8 are stopped by the partitioning bar 18 to be neatly aligned.

Thereafter, the feeding of the document originals is continued with the action plates 19 and 20 located in their home positions (see FIG. 4(*d*)). When the last one $D_n$ of the document originals D previously set in the setting position (the uppermost document original at the document setting) is fed out of the document placing plate 8, the set switch 14 is turned off. On the basis of the turn-off of the set switch 14, it is sensed that there is no document original on the document placing plate 8 yet to be fed.

Upon completion of the image reading of the document originals D previously set in the setting position, the recycle document feeder assumes a state as shown in FIG. 4(*e*). At this time, one copy of the document originals D is completed.

Where a plurality of copies are to be made, the partitioning bar 18 is retracted within the partitioning unit 17 so as to be shifted from the state shown in FIG. 4(*e*) to the inactive state, and then the action plates 19 and 20 are moved from their home positions in the direction of an arrow 103. Thus, the trailing edge of the stack of document originals D is pushed by the action plates 19 and 20 so that the document stack is moved toward the setting position. That is, the action plates 19 and 20 also function to transport the stack of document originals D for re-feeding of the document originals D.

When the stack of document originals D reaches the preset switch 13 to turn on the present switch 13, the driving of the feed belts 11 and 12 is started. The speed at which the action plates 19 and 20 are moved is set lower than the driving speed of the feed belts 11 and 12. Upon the start of the driving of the feed belts 11 and 12, the stack of document originals D is transported by the feed belts 11 and 12. When the stack of document originals D reaches the set switch 14, the set switch 14 is turned on. After a lapse of the predetermined time period from the turn-on of the set switch 14, the driving of the feed belts 11 and 12 is stopped. Thus, the stack of document originals D is set again in the setting position. Thereafter, the action plates 19 and 20 are stopped in such a position that they abut against the trailing edge of the stack of document originals D, and the partitioning bar 18 is lowered. Then, the second document feeding operation cycle is performed (see FIG. 4(*b*)).

When the recycle document feeder assumes the state shown in FIG. 4(*e*) after a required number of copies are made, the partitioning bar 18 is retracted within the partitioning unit 17. Then, the partitioning unit 17 is returned to its home position (see FIG. 4(*g*)). Therefore, the partitioning unit 17 does not hinder a user from removing the document originals D from the document placing plate 8.

Thus, the leading edges of the document originals D fed back onto the document placing plate 8 are aligned by the partitioning bar 18. Accordingly, the user can readily remove the document originals from the document placing plate 8 after the completion of the document feeding operation.

The partitioning unit 17 is not returned to its home position until the completion of the document feeding operation, and the partitioning bar 18 is kept in the active state during the document feeding operation cycle. Therefore, an operation noise which may be made in the case of the prior art recycle document feeder does not grate upon user's ears.

Figure 5:
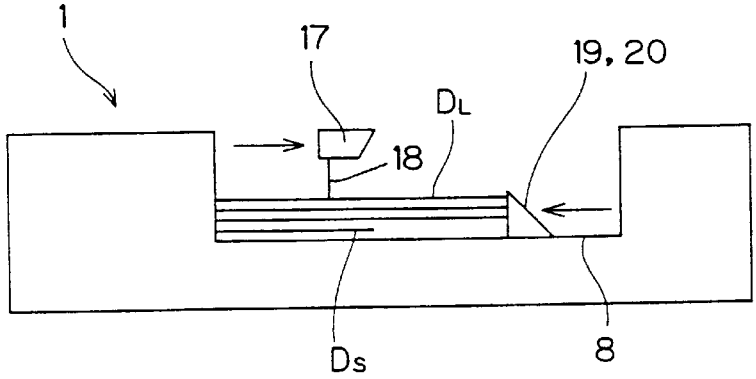
FIGS. 5(*a*) to 5(*c*) are schematic diagrams for explaining the function of a switch claw.
Figure 5:
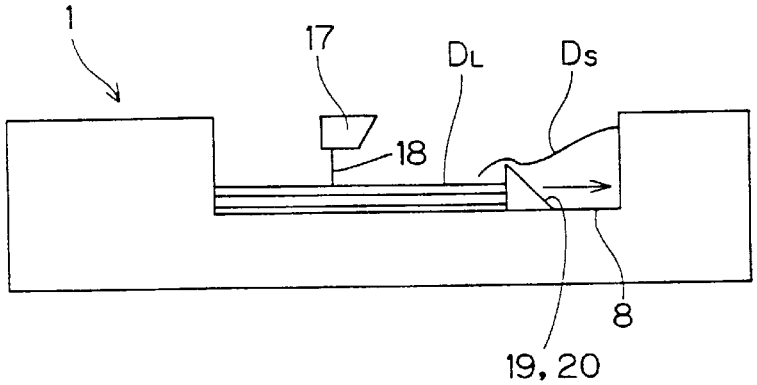
Figure 5:
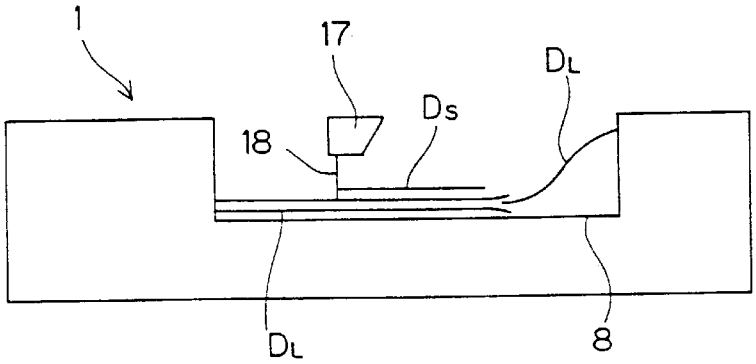

As described above, the partitioning unit 17 and the action plates 19 and 20 are moved to positions which depend on the size of the document originals set on the document placing plate 8. Therefore, in general, the document original fed back onto the document placing plate 8 is not mingled with the document originals set on the document placing plate.

Where larger size document originals $D_L$ are placed atop a smaller size document original $D_S$ on the document placing plate 8 as shown in FIG. 5(*a*), however, the partitioning unit 17 and the action plates 19 and 20 are moved to positions corresponding to the larger size document originals $D_L$. When the document transportation operation is started, the smaller size document original $D_S$ is guided by the action plates 19 and 20 so as to be fed back onto the document originals set on the document placing plate 8 (see FIG. 5(*b*)).

At this time, the entire document original $D_S$ is put on the document originals $D_L$ so that the trailing edges of the document originals $D_L$ are not covered with the document original $D_S$, because the document original $D_S$ has a smaller size. Therefore, after the action plates 19 and 20 are returned to their home positions, a document original $D_L$ subsequently fed back onto the document placing plate may be mingled with the document originals $D_L$ yet to be subjected to the transportation operation and, therefore, may be fed again undesirably.

To prevent such an inconvenience, the recycle document feeder 1 according to this embodiment is provided with the switch claw 253 which can be shifted between the recycle position which permits the document original transported into the document discharge portion 30 to be guided to the feedback path 32 and the discharge position which permits the document original to be discharged out of the feeder through the discharge port 252.

When the smaller size document original $D_S$ is transported into the document discharge portion, for example, the switch claw 253 is located in the discharge position as indicated by the two-dot-and-dash line in FIG. 1 to discharge the smaller size document original $D_S$ into the discharge tray 254. When a larger size document original $D_L$ is subsequently transported into the document discharge portion, the switch claw 253 is shifted to the recycle position as indicated by the solid line in FIG. 1 to feed the larger size document original $D_L$ back onto the document placing plate 8. Hence, only the larger size document originals $D_L$ are fed back onto the document placing plate 8, so that the document originals thus fed back are not fed again undesirably.

When the document original is to be discharged into the discharge tray 254 with the switch claw 253 shifted to the discharge position, the document original subjected to the image reading operation by the copying machine is preferably once taken back from the contact glass 3 into the reversing path 28 for reversion thereof before the discharging thereof. Thus, the document original is discharged into the discharge tray 254 with its front face upward.

The size of the transported document original can be determined on the basis of a time period from the start of the rotation of the registration roller 25 to the turn-off of the registration switch 24. If the document original is transported at a constant rate by the registration roller 25, the lapse of time before the trailing edge of the transported document original passes the registration switch 24 corresponds to the length of the document original. Therefore, the determination of the document size (document length) can be achieved by comparing the time period with reference time periods preliminarily measured for various sizes of document originals.

Figure 6:
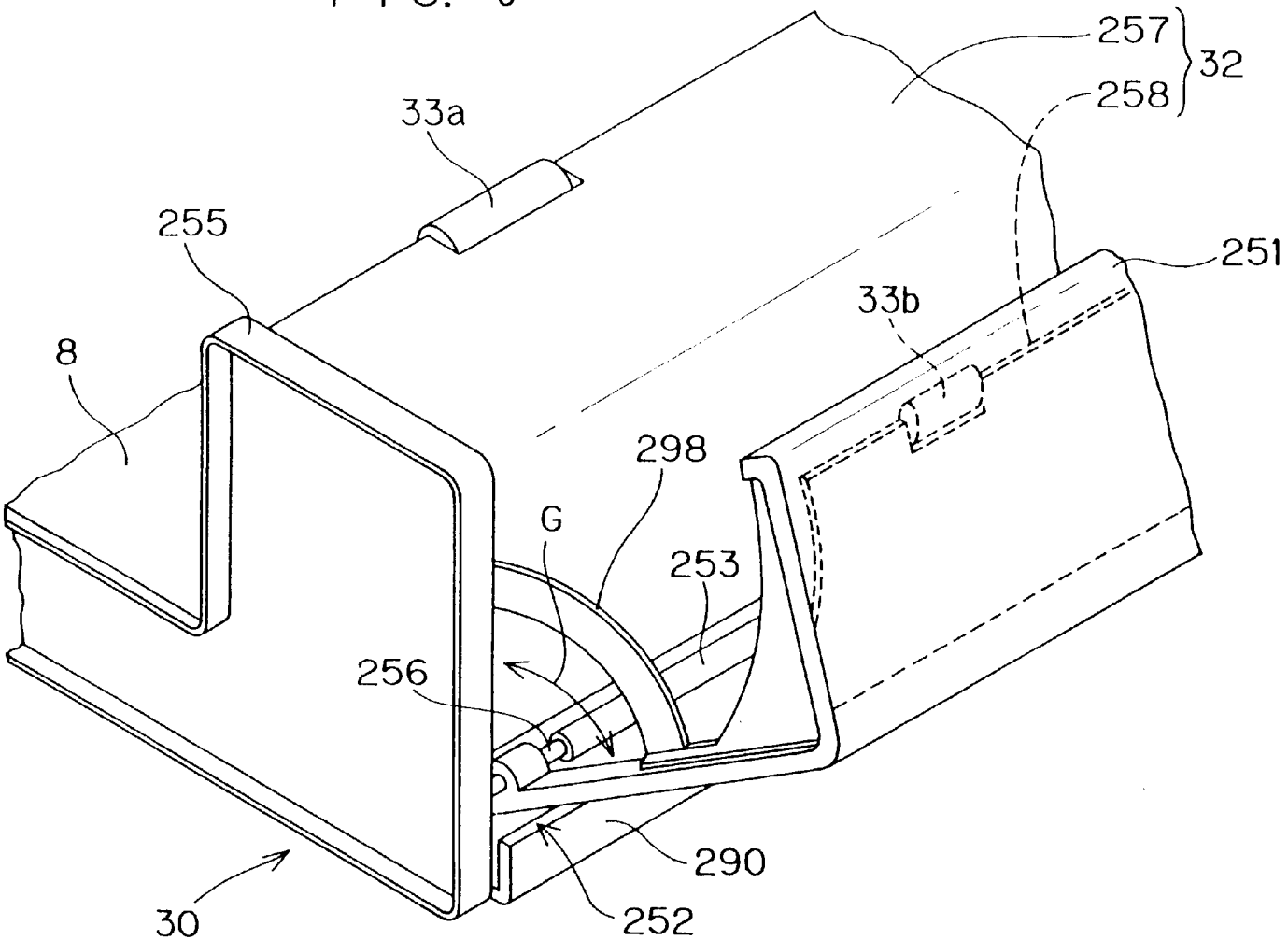
FIG. 6 is a perspective view illustrating the construction of a document discharge portion.

FIG. 6 is a perspective view illustrating the construction of the document discharge portion 30.

Referring to FIG. 6, the cover 251 is of a synthetic resin and has an inverted L shape in section. The cover 251 is openably supported by a pivot shaft 256 between a pair of frames 255 (only a front side frame is shown) opposed to each other perpendicularly to the document transportation direction. More specifically, the opposite ends of the pivot shaft 256 are supported by the pair of frames 255, and the cover 251 is pivotally attached to the pivot shaft 256. A pivoting restriction member 298 for restricting the pivoting of the cover 251 is attached to the cover 251 so that the cover 251 can be pivoted within a predetermined angle range G for the opening and closing thereof.

The feed-back path 32 for guiding the document original onto the document placing plate is defined by a lower guide member 257 and an upper guide member 258 provided in an opposed relation. Opposite edges of the lower guide member 257 are held by the pair of frames 255, and the upper guide member 258 is fixed on the interior face of the cover 251. The feed-back roller pair 33 includes a lower feed-back roller 33*a* and an upper feed-back roller 33*b*. The opposite ends of a rotation shaft (not shown) of the lower feed-back roller 33*a* are rotatably supported by the pair of frames 255, and the upper feed-back roller 33*b* is rotatably attached to the cover 251.

Therefore, when the cover 251 is opened, the upper guide member 258 and the upper feed-back roller 33*b* are displaced along with the cover 251, so that the lower guide member 257 is exposed and the nipping state of the roller pair 33 is canceled. Thus, when the document original is jammed in the path 32, the jammed document original can readily be removed simply by opening the cover 251.

The switch claw 253 for switching the document traveling direction is attached to the pivot shaft 256 which supports the cover 251. One feature of this embodiment is that the switch claw 253 is attached to the pivot shaft 256. The construction of the switch claw 253 is shown in FIG. 7.

Figure 7:
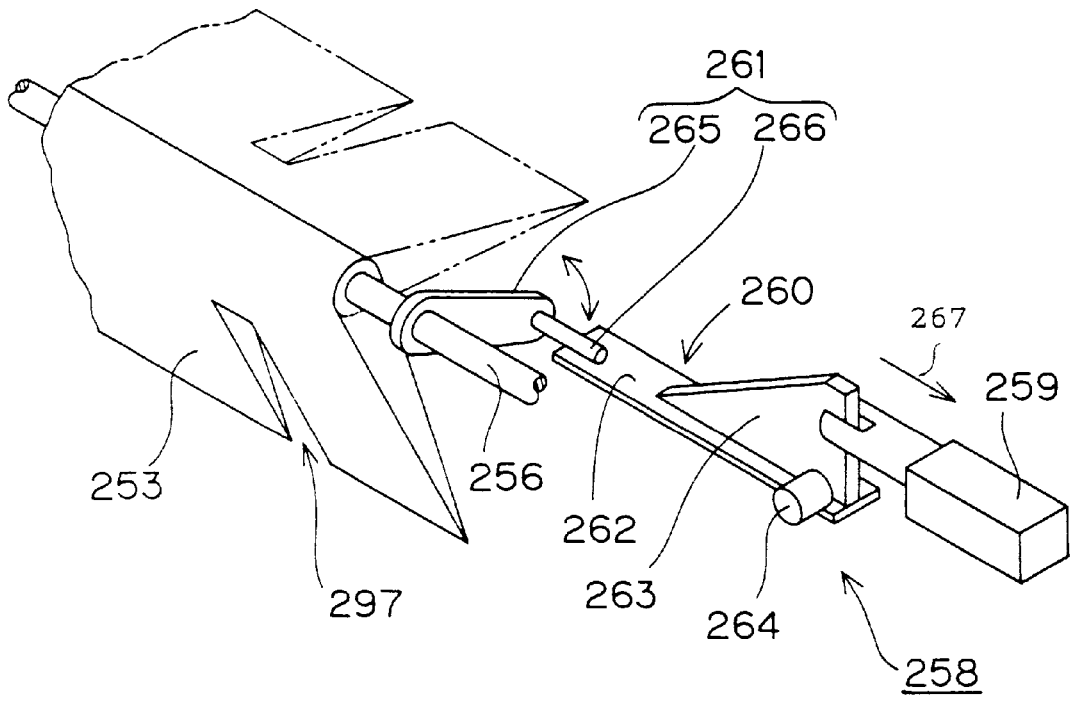
FIG. 7 is a perspective view illustrating an arrangement for shifting the switch claw.

Referring to FIG. 7, the switch claw 253 is molded from a synthetic resin and has substantially the same width as the width of a document original to be possibly transported. The switch claw 253 has a wedge shape in section. The pivot shaft 256 extends through a base portion of the switch claw 253. The switch claw 253 has a plurality of cut-away portions 297 to prevent a distal edge thereof to interfere with the feed roller pair 31 shown in FIG. 1 and ribs (not shown) which are provided on the lower cover 290 to define the document transportation path.

A claw driving mechanism 258 for shifting the switch claw 253 between the recycle position indicated by a solid line and the discharge portion indicated by a two-dot-and-dash line is provided on one side (front side in FIG. 7) of the switch claw 253. The claw driving mechanism 258 includes a claw driving solenoid 259, a swivel member 260 adapted to be vertically swiveled by the claw driving solenoid 259, and a lever member 261 attached to the pivot shaft 256.

The swivel member 260 has a plate portion 262 and an upright portion 263 extending upright on the upper face of the plate portion 262. The claw driving solenoid 259 is connected to an upper end of the upright portion 263. When the claw driving solenoid 259 is turned on and off, the plate portion 262 of the swivel member 260 is swiveled up and down about a shaft 264. The lever member 261 has an elongate lever body 265 extending perpendicularly to the pivot shaft 256 and a pin 266 extending parallel to the pivot shaft 256 outwardly of the distal end of the lever body 265.

When the claw driving solenoid 259 is off, the switch claw 253 is located in the recycle position with its distal portion directing downward by its weight. When the claw solenoid 259 is turned on in this state, the upright portion 263 of the swivel member 260 is drawn in the direction of an arrow 267 so that the swivel member 260 is swiveled about the shaft 264. As a result, the distal end of the plate portion 262 of the swivel member 260 is displaced upward, so that the pin 266 of the lever member 261 is lifted. Thus, the pivot shaft 256 is rotated counterclockwise as seen in FIG. 7, whereby the switch claw 253 is shifted to the discharge position indicated by the two-dot-and-dash line.

As described above, the switch claw 253 is attached to the pivot shaft 256 which supports the cover 251 in accordance with this embodiment. Therefore, there is no need for additionally providing a shaft for supporting the switch claw 253, thereby simplifying the construction of the document discharge portion 30. In addition, a space can be saved when compared with a case where the cover 251 and the switch claw 253 are supported by different pivot shafts and these pivot shafts are disposed along different axes.

Since the switch claw 253 is attached to the pivot shaft 256, the cover 251 and the switch claw 253 do not interfere with each other when the cover 251 is opened or closed. Therefore, the pivot angle range G (see FIG. 6) of the cover 251 can be increased.

Even if the document jam occurs in the vicinity of the switch claw 253, the jammed document original can readily and conveniently be removed simply by opening the cover 251.

While one embodiment of the present invention has thus been described, the invention is not limited to the embodiment. Although the cover and the switch claw share a single pivot shaft in the embodiment described above, the pivot shaft of the cover and the pivot shaft of the switch claw may otherwise be provided in a coaxial relation. In this case, a space can also be saved drastically when compared with the case where these pivot shafts are disposed along different axes.

What is claimed is:

1. A recycle document feeder comprising:

a document placing plate for holding thereon document originals to be fed;

feed means for feeding the document originals previously set on the document placing plate one by one into a transportation path;

transportation means for transporting a document original through the transportation path;

feed-back path for feeding the document original once fed into the transportation path back onto the document placing plate;

a discharge port branched from the feed-back path for discharging therethrough the document original out of the feeder;

a cover pivotal about a pivot shaft and covering at least the feed-back path; and a switch claw pivotal about a pivot shaft provided in a coaxial relation with respect to the pivot shaft of the cover for switching a path through which the document original is guided either to the feed-back path or to the discharge port, depending on its pivoted position.

2. A recycle document feeder as set forth in claim 1, wherein the feed-back path is defined by a pair of guide members provided in an opposed relation, and wherein one of the pair of guide members is attached to the cover and adapted to be pivoted along with the cover.

3. A recycle document feeder as set forth in claim 2, further comprising:

a pair of feed-back rollers provided adjacent to a downstream end of the feed-back path for feeding the document original back onto the document placing plate, wherein one of the pair of feed-back rollers is attached to the cover and adapted to be displaced by the pivoting of the cover.

4. A recycle document feeder as set forth in claim 1, further comprising:

detection means for detecting a document original of a predetermined size transported by the transportation means in a case where document originals having different sizes are set on the document placing plate; and control means for switching the switch claw, in response to a detection output of the detection means, to guide the document original of the predetermined size to the discharge port.

5. A recycle document feeder as set forth in claim 1, further comprising control means for switching the switch claw, the control means being adapted to shift the switch claw to a pivot position which depends on the size of the document originals set on the document placing plate or the size of the document original transported by the transportation means.

6. A recycle document feeder as set forth in claim 1, further comprising a partitioning unit provided above the document placing plate and reciprocally movable in a document transportation direction, the partitioning unit being adapted to stop a leading edge of the document original fed back onto the document placing plate.

7. A recycle document feeder as set forth in claim 6, wherein the partitioning unit includes a partitioning bar which is shifted between an inactive state where it is retracted within the partitioning unit and an active state where it stops the leading edge of the document original fed back onto the document placing plate.

8. A recycle document feeder as set forth in claim 6, further comprising:

document size sensing means for sensing the size of the document originals set on the document placing plate, wherein the partitioning unit is moved to a predetermined position which depends on the size of the document originals sensed by the document size sensing means when document transportation is started.

9. A recycle document feeder as set forth in claim 8, further comprising an action plate reciprocally movable in the document transportation direction on the document placing plate and adapted to guide, at least when a document original first transported is fed back onto the document placing plate, the document original in such a manner that a leading edge thereof is directed toward an upper side of trailing edges of document originals remaining on the document placing plate and, after the document originals previously set on the document placing plate are all subjected to a document transportation cycle and fed back onto the document placing plate, push trailing edges of the document originals fed back onto the document placing plate to transport the document originals toward a document setting position.

10. A recycle document feeder as set forth in claim 9, wherein the action plate is of a generally right-angled triangular shape having an edge inclined upward in the document transportation direction as viewed horizontally and perpendicularly to the document transportation direction.

* * * * *